US010009685B2

(12) United States Patent
Hu et al.

(10) Patent No.: US 10,009,685 B2
(45) Date of Patent: Jun. 26, 2018

(54) SYSTEMS AND METHODS FOR LOUDSPEAKER ELECTRICAL IDENTIFICATION WITH TRUNCATED NON-CAUSALITY

(71) Applicant: Cirrus Logic International Semiconductor Ltd., Edinburgh (GB)

(72) Inventors: Rong Hu, Austin, TX (US); Jie Su, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days. days.

(21) Appl. No.: 15/453,718

(22) Filed: Mar. 8, 2017

(65) Prior Publication Data

US 2017/0280240 A1 Sep. 28, 2017

Related U.S. Application Data

(60) Provisional application No. 62/366,865, filed on Jul. 26, 2016, provisional application No. 62/311,739, filed on Mar. 22, 2016.

(51) Int. Cl.

| | |
|---|---|
| ***H04R 3/02*** | (2006.01) |
| ***H04R 29/00*** | (2006.01) |
| ***H04R 3/00*** | (2006.01) |
| ***H04R 3/04*** | (2006.01) |

(52) U.S. Cl.

CPC ..... *H04R 3/02* (2013.01); *H04R 3/007* (2013.01); *H04R 3/04* (2013.01); *H04R 29/001* (2013.01)

(58) Field of Classification Search

CPC . H04R 3/02; H04R 3/007; H04R 3/04; H04R 29/001

See application file for complete search history.

(56) References Cited

U.S. PATENT DOCUMENTS

| | | | | |
|---|---|---|---|---|
| 5,528,695 | A | 6/1996 | Klippel | |
| 2007/0223755 | A1* | 9/2007 | Salvetti | H04M 9/082 381/318 |
| 2015/0319529 | A1 | 11/2015 | Kilppel | |
| 2016/0309255 | A1 | 10/2016 | Marcone et al. | |

OTHER PUBLICATIONS

International Search Report and Written Opinion of the International Searching Authority, International Application No. PCT/US2017/023332, dated May 23, 2017.

Chang, P-R et al., Inverse Filtering of a Loudspeaker and Room Acoustics Using Time-Delay Neural Networks, The Journal of the Acoustical Society of America, American Institute of Physics for the Acoustical Society of America, New York, NY, vol. 95, No. 6, Jun. 1, 1994, pp. 3400-3408.

Combined Search and Examination Report under Sections 17 and 18(3) of the United Kingdom Intellectual Property Office, Application No. GB1704393.6, dated May 3, 2017.

* cited by examiner

*Primary Examiner* — Mark Fischer

(74) *Attorney, Agent, or Firm* — Jackson Walker L.L.P.

(57) ABSTRACT

In accordance with embodiments of the present disclosure, a method may include using an adaptive filter system to estimate a response of an electrical characteristic of a loudspeaker based on an error between a first electrical parameter of the loudspeaker and a second electrical parameter of the loudspeaker and adding a non-zero delay to the first electrical parameter relative to the second electrical parameter prior to calculation of the error such that the adaptive filter system captures a truncated non-causality of the electrical characteristic.

14 Claims, 3 Drawing Sheets

SYSTEMS AND METHODS FOR LOUDSPEAKER ELECTRICAL IDENTIFICATION WITH TRUNCATED NON-CAUSALITY

RELATED APPLICATIONS

The present application claims priority to U.S. Prov. Pat. App. Ser. No. 62/311,739 filed Mar. 22, 2016 and entitled "Loudspeaker Electrical Identification Capturing Non-Truncated Causality and a New Framework for Speaker Protection" and U.S. Prov. Pat. App. Ser. No. 62/366,865 filed Jul. 26, 2016 and entitled "Loudspeaker Electrical Identification Capturing Truncated Non-Causality and A New Framework for Speaker" both of which are incorporated herein by reference.

FIELD OF DISCLOSURE

The present disclosure relates in general to audio speakers, and more particularly, to modeling of a speaker system in order to protect audio speakers from damage and other uses.

BACKGROUND

Audio speakers or loudspeakers are ubiquitous on many devices used by individuals, including televisions, stereo systems, computers, smart phones, and many other consumer devices. Generally speaking, an audio speaker is an electroacoustic transducer that produces sound in response to an electrical audio signal input.

Given its nature as a mechanical device, an audio speaker may be subject to damage caused by operation of the speaker, including overheating and/or overexcursion, in which physical components of the speaker are displaced too far a distance from a resting position. To prevent such damage from happening, speaker systems often include control systems capable of controlling audio gain, audio bandwidth, and/or other components of an audio signal to be communicated to an audio speaker.

Such control systems operate based on various measured characteristics of a speaker system. For example, a control system may sense a current and voltage associated with a loudspeaker and based thereon, determine an electrical impedance or an electrical admittance of the speaker. Such electrical impedance or an electrical admittance, as well as one or more other mechanical or electrical parameters associated with the speaker system, may then be processed to determine or estimate a displacement of a speaker, and control the speaker system such that the displacement does not exceed a maximum displacement in which damage to the speaker may occur.

Existing speaker protection control systems often employ a "causal architecture" between measured voltage and measured current, thus permitting only the capture by the control system of causal characteristics of the relationship between the measured current and the measured voltage. Accordingly, such an architecture is incapable of capturing non-causal portions of electrical admittance or impedance responses, and thus can lead to electrical system identification inaccuracies, limited working frequency ranges, and/or other disadvantages.

SUMMARY

In accordance with the teachings of the present disclosure, certain disadvantages and problems associated with loudspeaker electrical identification have been reduced or eliminated.

In accordance with embodiments of the present disclosure, a method may include using an adaptive filter system to estimate a response of an electrical characteristic of a loudspeaker based on an error between a first electrical parameter of the loudspeaker and a second electrical parameter of the loudspeaker and adding a non-zero delay to the first electrical parameter relative to the second electrical parameter prior to calculation of the error such that the adaptive filter system captures a truncated non-causality of the electrical characteristic.

In accordance with these and other embodiments of the present disclosure, a system may include an adaptive filter system configured to estimate a response of an electrical characteristic of a loudspeaker based on an error between a first electrical parameter of the loudspeaker and a second electrical parameter of the loudspeaker and a non-zero delay configured to provide a delay of the first electrical parameter relative to the second electrical parameter prior to calculation of the error such that the adaptive filter system captures a truncated non-causality of the electrical characteristic.

In accordance with these and other embodiments of the present disclosure, a speaker protection method may include calculating a real-time velocity or an equivalently maximum kinetic energy of moving parts, to model or monitor a speaker, and adding a limit to peaks of the real time velocity or peaks of the equivalently maximum kinetic energy to set a speaker protection level.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are explanatory examples and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
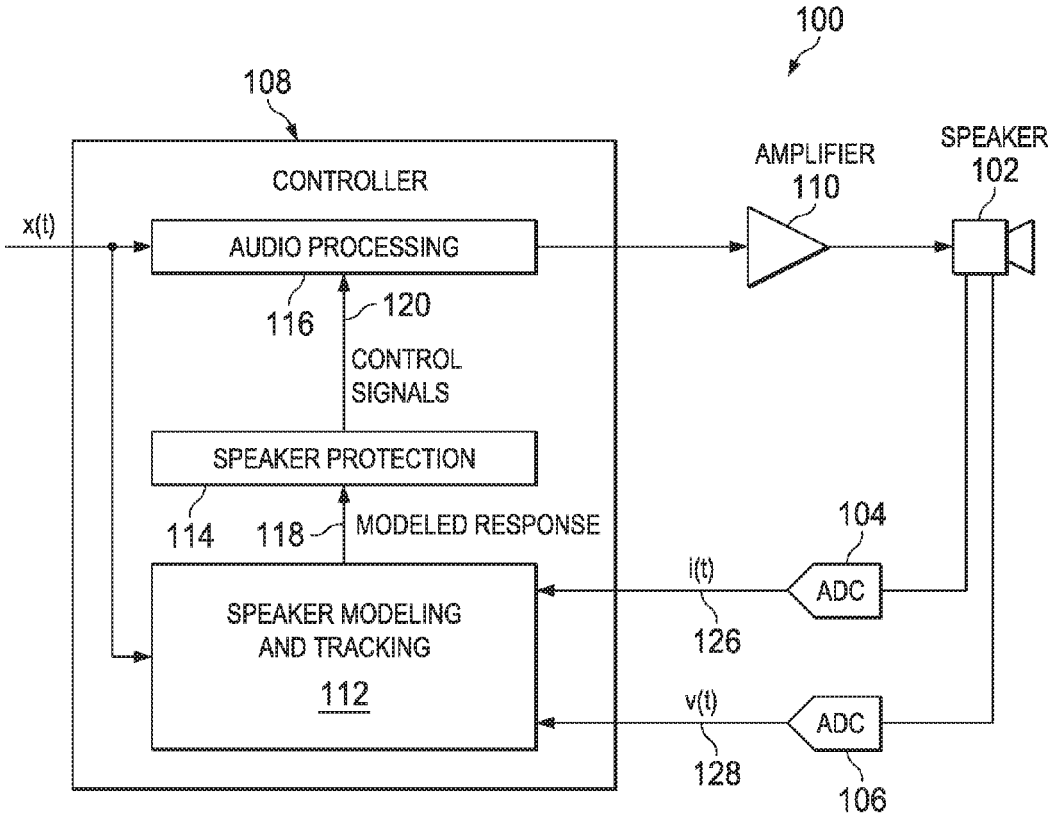
FIG. 1 illustrates a block diagram of an example system that uses speaker modeling and tracking to control operation of an audio speaker, in accordance with embodiments of the present disclosure.

FIG. 1 illustrates a block diagram of an example system 100 that employs a controller 108 to control the operation of an audio speaker 102, in accordance with embodiments of the present disclosure. Audio speaker 102 may comprise any suitable electroacoustic transducer that produces sound in response to an electrical audio signal input (e.g., a voltage or current signal). As shown in FIG. 1, controller 108 may generate such an electrical audio signal input, which may be further amplified by an amplifier 110. In some embodiments, one or more components of system 100 may be integral to a single integrated circuit (IC).

Controller 108 may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, controller 108 may interpret and/or execute program instructions and/or process data stored in a memory (not explicitly shown) communicatively coupled to controller 108. As shown in FIG. 1, controller 108 may be configured to perform speaker modeling and tracking 112, speaker protection 114, and/or audio processing 116, as described in greater detail below.

Amplifier 110 may be any system, device, or apparatus configured to amplify a signal received from controller 108 and communicate the amplified signal (e.g., to speaker 102). In some embodiments, amplifier 110 may comprise a digital amplifier configured to also convert a digital signal output from controller 108 into an analog signal to be communicated to speaker 102.

The audio signal communicated to speaker 102 may be sampled by each of an analog-to-digital converter 104 and an analog-to-digital converter 106, configured to respectively detect an analog current and an analog voltage associated with the audio signal, and convert such analog current and analog voltage measurements into digital signals 126 and 128 to be processed by controller 108. Based on digital current signal 126, digital voltage signal 128, and an audio input signal x(t), controller 108 may perform speaker modeling and tracking 112 in order to generate a modeled response 118. Modeled response 118 may include one or more modeled mechanical and/or electrical parameters derived from digital signals 126 and 128, including without limitation a predicted displacement for speaker 102, an electrical admittance of speaker 102, and an electrical impedance of speaker 102. In some embodiments, speaker modeling and tracking 112 may provide a recursive, adaptive system to generate such modeled response 118.

Controller 108 may perform speaker protection 114 based on one or more operating characteristics of the audio speaker, including without limitation modeled response 118. For example, speaker protection 114 may compare modeled response 118 (e.g., a predicted displacement y(t)) to one or more corresponding speaker protection thresholds (e.g., a speaker protection threshold displacement), and based on such comparison, generate one or more control signals for communication to audio processing 116. Thus, by comparing a predicted displacement y(t) (as included within modeled response 118) to an associated speaker protection threshold displacement, speaker protection 114 may generate control signals for modifying one or more characteristics of audio input signal x(t) (e.g., amplitude, frequency, bandwidth, phase, etc.) while providing a psychoacoustically pleasing sound output (e.g., control of a virtual bass parameter).

Based on one or more control signals 120, controller 108 may perform audio processing 116, whereby it applies the various control signals 120 to process audio input signal x(t) and generate an electrical audio signal input as a function of audio input signal x(t) and the various speaker protection control signals, which controller 108 communicates to amplifier 110.

Figure 2:
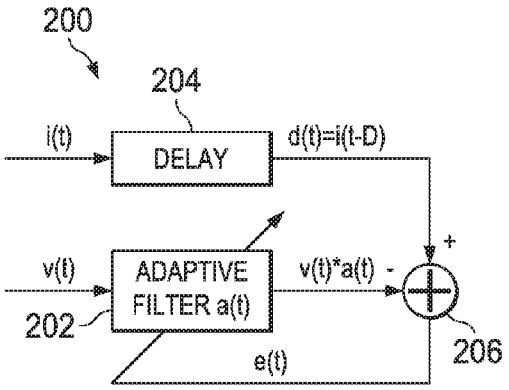
FIG. 2 illustrates a model for modeling and tracking electrical admittance of an audio speaker, in accordance with embodiments of the present disclosure.

FIG. 2 illustrates a model 200 for modeling and tracking electrical admittance of an audio speaker (e.g., speaker 102), in accordance with embodiments of the present disclosure. In some embodiments, model 200 may be integral to speaker modeling and tracking 112 of FIG. 1. As shown in FIG. 2, model 200 may include an adaptive filter 202, a delay 204, and a combiner 206.

Adaptive filter 202 may include any suitable filter (e.g., an infinite impulse response filter, a finite impulse response filter, etc.) which adapts its response a(t), which is indicative of an electrical admittance of an audio speaker (e.g., speaker 102) based on an error signal e(t) generated by combiner 206 in order to minimize error signal e(t). As shown in FIG. 2, adaptive filter 202 may apply admittance response a(t) to a voltage signal v(t) representing a voltage of the audio speaker in order to generate a signal v(t)*a(t) (where "*" indicates performance of a mathematical convolution) which, if admittance response a(t) has accurately tracked the electrical admittance of the audio speaker, will be approximately equal to a current signal i(t) representing a current of the audio speaker.

Delay 204 may receive current signal i(t) and apply a delay D, thus generating a delayed signal d(t)=i(t−D). Delay D may be any suitable delay, and may be determined in any suitable manner (e.g., via product development and testing). Combiner 206 may subtract signal v(t)*a(t) generated by adaptive filter 202 from delayed signal d(t) in order to generate error signal e(t) which may be used by adaptive filter 202 for adaptation of admittance response a(t). Admittance esponse a(t) may be used, alone or in combination with one or more other actual and/or modeled parameters of the audio speaker (e.g., mechanical and/or electrical parameters), by speaker modeling and tracking 112 to generate modeled response 118.

Figure 3:
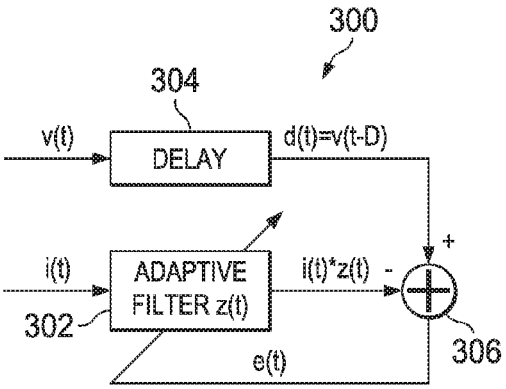
FIG. 3 illustrates a model for modeling and tracking electrical impedance of an audio speaker, in accordance with embodiments of the present disclosure.

FIG. 3 illustrates a model 300 for modeling and tracking electrical impedance of an audio speaker (e.g., speaker 102), in accordance with embodiments of the present disclosure. In some embodiments, model 300 may be integral to speaker modeling and tracking 112 of FIG. 1, and may be used by speaker modeling and tracking 112 in addition to or in lieu of model 200 of FIG. 2. As shown in FIG. 3, model 300 may include an adaptive filter 302, a delay 304, and a combiner 306.

Adaptive filter 302 may include any suitable filter (e.g., an infinite impulse response filter, a finite impulse response filter, etc.) which adapts its response z(t), which is indicative of an electrical impedance of an audio speaker (e.g., speaker 102) based on an error signal e(t) generated by combiner 306 in order to minimize error signal e(t). As shown in FIG. 3, adaptive filter 302 may apply impedance response z(t) to a current signal i(t) representing a current of the audio speaker in order to generate a signal i(t)*z(t) which, if impedance response z(t) has accurately tracked the electrical impedance of the audio speaker, will be approximately equal to a voltage signal v(t) representing a voltage of the audio speaker.

Delay 304 may receive voltage signal v(t) and apply a delay D, thus generating a delayed signal d(t)=v(t−D). Delay D may be any suitable delay, and may be determined in any suitable manner (e.g., via product development and testing). Combiner 306 may subtract signal i(t)*z(t) generated by adaptive filter 302 from delayed signal d(t) in order to generate error signal e(t) which may be used by adaptive filter 302 for adapting impedance response z(t). Impedance response z(t) may be used, alone or in combination with one or more other actual and/or modeled parameters of the audio speaker (e.g., mechanical and/or electrical parameters), by speaker modeling and tracking 112 to generate modeled response 118.

Because of the relationship between electrical admittance and electrical impedance (one is the inverse of the other), for the remainder of this disclosure and in the claims, such terms may be used interchangeably and equivalently.

Model 200 and model 300 may each be thought of as truncated non-causality capturing architectures. In the architectures of model 200 and model 300, an adaptive filter (e.g., adaptive filter 202, adaptive filter 302) may capture a delayed and truncated (delayed and truncated by the length of delay D) non-causal portion of an admittance or impedance response.

Figure 4:
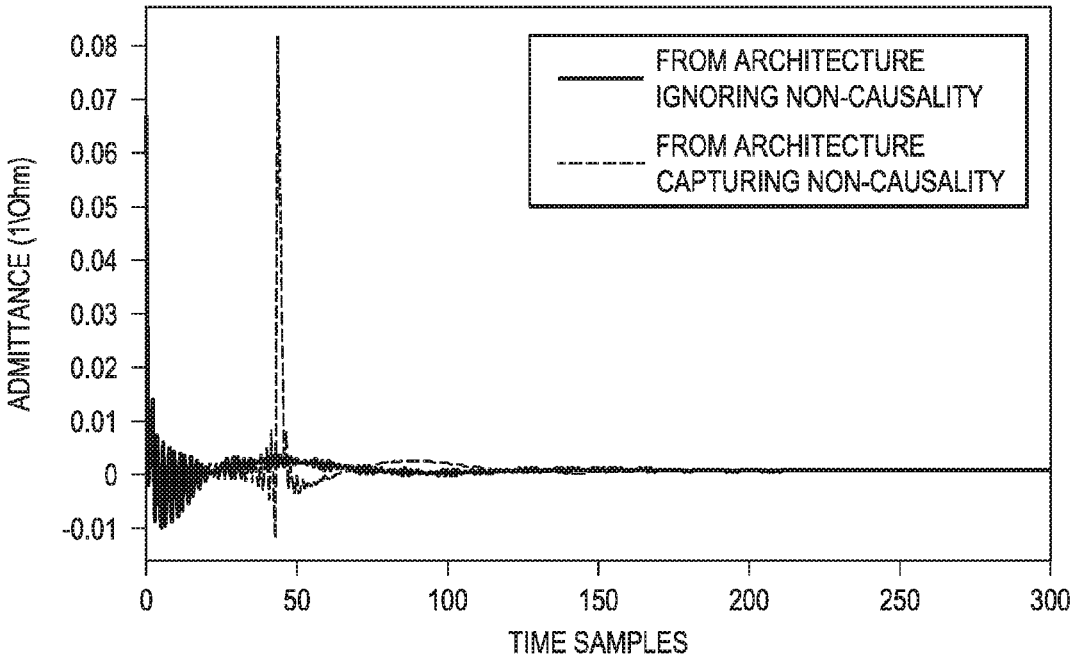
FIG. 4 illustrates a waveform of admittance versus time of a delayed admittance impulse response and a non-delayed impulse response in which an adaptive filter comprises a finite impulse response filter, in accordance with embodiments of the present disclosure.

FIG. 4 illustrates a waveform of admittance versus time of a delayed admittance impulse response and a non-delayed impulse response in which adaptive filter 202 comprises a finite impulse response filter, in accordance with embodiments of the present disclosure. The dashed waveform of FIG. 4 depicts admittance versus time of a delayed admittance impulse response in an architecture such as that depicted in FIG. 2 having a particular delay D (e.g., 1 millisecond), while the solid waveform of FIG. 4 depicts admittance versus time of a delayed admittance impulse response in an architecture such as that depicted in FIG. 2 with delay 204 absent (or delay D equal to zero). In FIG. 4, the oscillatory leading samples of the dashed curve ahead of the peak, although truncated, are non-zero, which depicts the non-causal behavior, as shown in the dashed curve. Although the causal portion behind (and including) the peak dominates in the overall energy and mainly represents behavior at lower frequency regions, the preceding non-causal portion has enough level of energy that is non-negligible, and needs to be captured for an accurate identification of the speaker characteristics. It is expected that an analogous result would occur with respect to electrical impedance in the architecture depicted in FIG. 3.

Figure 5:
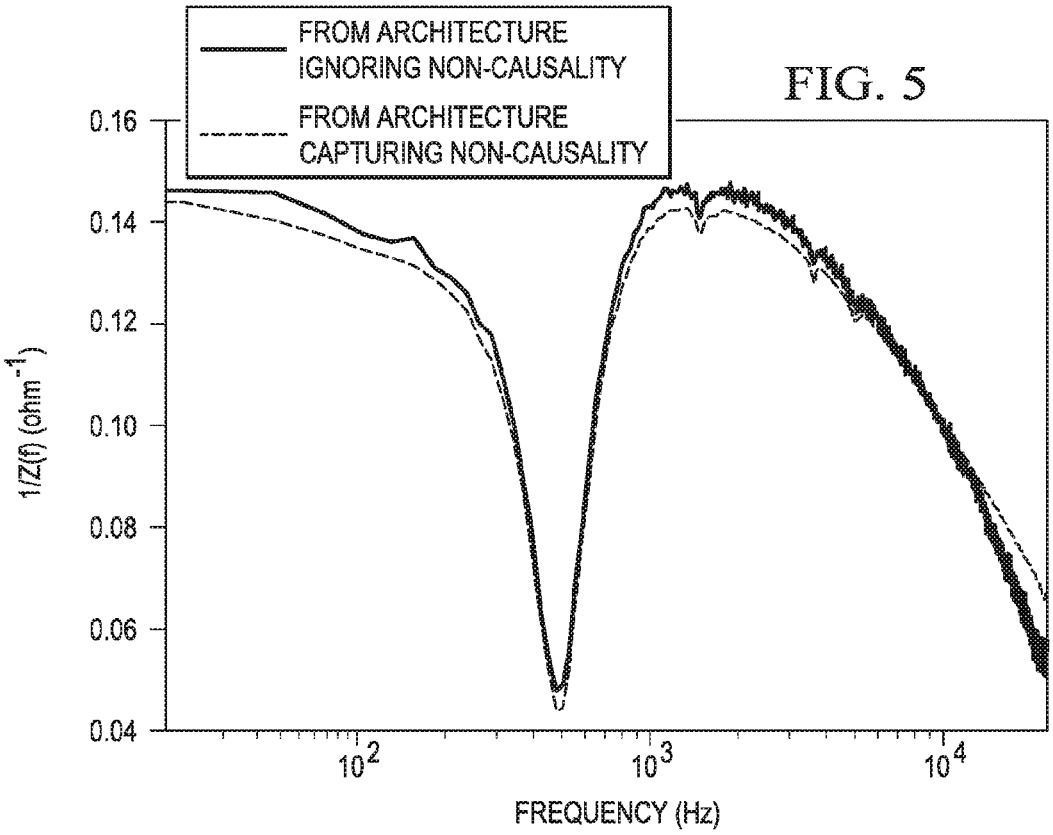
FIG. 5 illustrates a graph of admittance versus frequency of a delayed admittance impulse response and a non-delayed impulse response in which an adaptive filter comprises a finite impulse response filter, in accordance with embodiments of the present disclosure.
Figure 6:
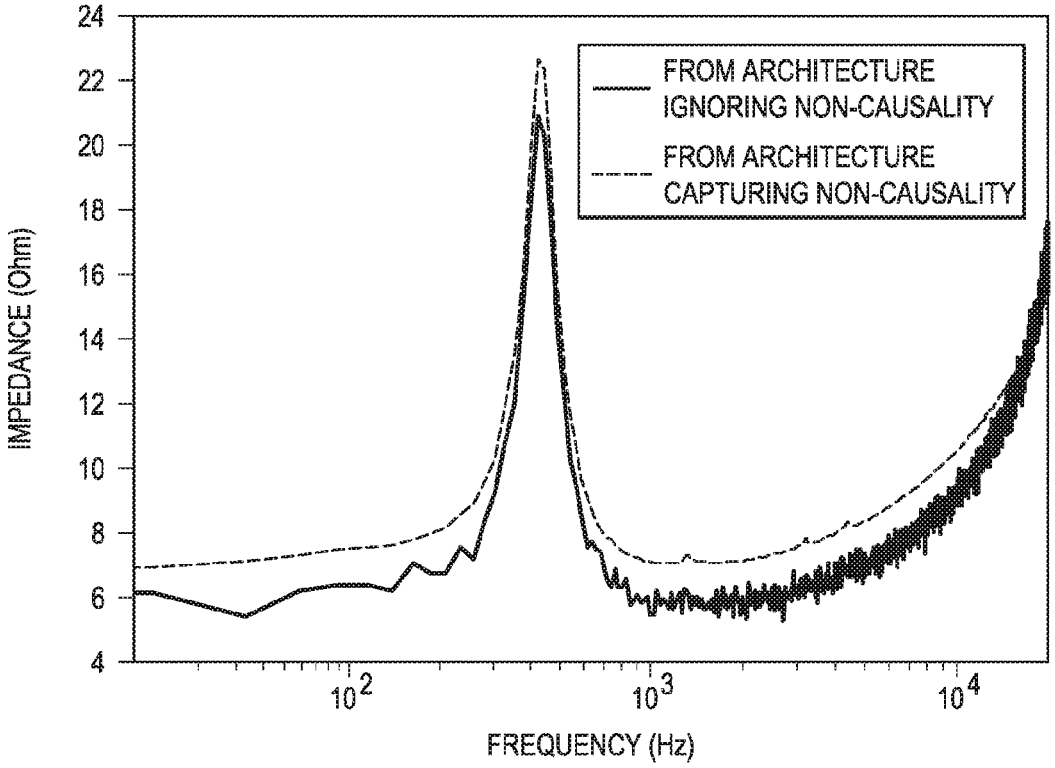
FIG. 6 illustrates a graph of impedance versus frequency of a delayed impedance impulse response and a non-delayed impulse response in which an adaptive filter comprises a finite impulse response filter, in accordance with embodiments of the present disclosure.

FIG. 5 illustrates an admittance frequency response of a delayed admittance impulse response and a non-delayed impulse response in which adaptive filter 202 comprises a finite impulse response filter, in accordance with embodiments of the present disclosure, while FIG. 6 illustrates an impedance frequency response of a delayed impedance impulse response and a non-delayed impulse response in which adaptive filter 302 comprises a finite impulse response filter, in accordance with embodiments of the present disclosure.

As is shown in FIGS. 5 and 6, causal architectures for electrical admittance and impedance may be less accurate than truncated non-causal architectures, and such inaccuracy may not be confined to a high frequency region only. In causal architectures, the introduction of inaccuracies by ignoring the non-causality of electrical impulse responses may cause larger errors in subsequent loudspeaker parameter extraction and speaker protection or correction controls. For example, a consequence is that, if a speaker voice coil temperature estimate, or a speaker electrical resistance estimate, is based on the admittance or impedance curves of a causal architecture, there may be risks of temperature underestimation. However, by using delayed non-causal architectures (e.g., those having finite delays D as shown in FIGS. 2 and 3), such inaccuracies and risks may be reduced for speaker protection and correction applications.

Although the foregoing examples depict use of adaptive finite impulse response filters, the concepts discussed above may also be true for architectures using adaptive infinite impulse response filters.

Although the foregoing contemplates loudspeaker electrical identification for use in speaker modeling and protection systems, it is understood that the method and systems for loudspeaker electrical identification described above may also be used in any suitable application other than speaker modeling and protection systems.

The method and systems for loudspeaker electrical identification described above, or any other suitable loudspeaker electrical identification, may be used for speaker protection based on voice coil velocity modeling and/or prediction. Traditionally, protection of loudspeakers from overheating and overexcursion are the goals of the speaker protection system. Often, the instantaneous velocity peaks of the movement of a speaker occur close to a balanced position of the voice coil of the speaker, and such velocity often reaches an instantaneous minimum around peak positions of speaker displacement, which may lead to the assumption that limiting the excursion to be within a certain threshold may be sufficient to protect the speaker. However, due to the nonlinear behaviors and natural compression mechanisms of a driver for driving the speaker, protection using limits on speaker displacement and temperature may still not provide sufficient protection for the speaker from long- or short-term detrimental factors. For example, the stiffness of driver suspension usually increases nonlinearly at large displacement levels, which may compress and confine speaker movement and may force its velocity to zero around the maximum of cone excursions, wherein the kinetic energy of the speaker movement may be transformed into potential energy which may subsequently be converted back to kinetic movement at the maximum of velocity. Therefore, limiting excursion within a certain predefined threshold does not necessarily ensure speaker safety, as there are other stresses and tension that store such potential energy which are distributed along the mechanical parts of the speaker driver (e.g., in the suspension system). Thus, during cycles between full kinetic energy and full potential energy, if the distribution of nonlinearities is uneven, distributed potential energies could cause unexpected movements of the speaker that could pose a threat to safe vibrations of the speaker driver. For example, an abnormal uneven distribution of the stiffness of the suspension could result in sudden drastic rocking or bending of a speaker diaphragm. Therefore, it may be desirable to monitor a total instantaneous mechanical energy for the movement of the speaker driver and to limit such energy within a safe range and prevent potential detrimental movements.

The total instantaneous mechanical energy of the moving diaphragm together with voice coil can be approximately described by its maximum kinetic energy:

$$E_M = \frac{1}{2} M_{ms} u_{max}^2(t)$$

Therefore, applying an energy threshold $E_{th}$ is equivalent to applying a threshold $$U_{Th}=\sqrt{2E_{Th}/M_{ms}}$$

to the peaks of the velocity, (i.e., $|u_{max}(t)|$), for safe loudspeaker movements.

The additional introduction of velocity threshold, or equivalently, maximum kinetic energy threshold, can work in connection with the displacement limit and the thermal or temperature limit of any existing speaker protection solution for improved safety of the speaker to be protected.

One embodiment of implementing voice coil velocity monitoring may include deriving the prediction of velocity through an additional motion sensor, which could be more expensive due to the need of additional sensor hardware. In another embodiment, such velocity could be predicted or modeled from existing displacement estimates $\hat{x}(t)$, using the simple mathematical relation of derivation $$\hat{u}(t) = \frac{d\hat{x}(t)}{dt}$$

Alternatively, in another embodiment, the velocity may be predicted from an estimate of a back EMF voltage ($v_{EMF}(t)$) of the electrical side of the speaker, using known mathematical relations:

$$\hat{u}(t) = \frac{1}{Bl}\hat{v}_{EMF}(t)$$

with Bl the force factor of the magnetic sub-system, and $$\hat{v}_{EMF}(t) = \hat{v}(t) - \left(R_e\hat{i}(t) + L_e\frac{d}{dt}\hat{i}(\tau)\right)$$

where $R_e$ is a DC resistance of a speaker, $L_e$ is a voice coil inductance of the speaker system, and $\hat{i}(\tau)$ the prediction of the current flowing through the speaker driver, which can be predicted from the estimate of voltage $\hat{v}(t)$ by:

$$\hat{i}(t)=\hat{v}(t)*\hat{a}(t)$$

using the admittance filter $\hat{a}(t)$ as shown in adaptive filter 202 of FIG. 2, which may be adaptively estimated in the above proposed adaptive identification architecture. In such an embodiment, the displacement estimate could be obtained as a byproduct of velocity estimate instead, by integration filtering:

$$\hat{x}(t)=\int_{-\infty}^{t}\hat{u}(\tau)d\tau$$

Either in such an embodiment, or in other embodiments mentioned above which may base their displacement or thermal modeling on the adaptively identified electrical admittance or electrical impedance, it may be advantageous to improve the identification accuracies of admittance or impedance by using the non-causal identification architectures described above.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. A method, comprising:

using an adaptive filter system to estimate a response of an electrical characteristic of a loudspeaker based on an error between a first electrical parameter of the loudspeaker and a second electrical parameter of the loudspeaker; and adding a non-zero delay to the first electrical parameter relative to the second electrical parameter prior to calculation of the error such that the adaptive filter system captures a truncated non-causality of the electrical characteristic.

2. The method of claim 1, wherein the first electrical parameter is a current of the loudspeaker, the second electrical parameter is a voltage of the loudspeaker, and the electrical characteristic is an electrical admittance of the loudspeaker.

3. The method of claim 2, wherein the method further comprises:

filtering the second electrical parameter with a filter response of the adaptive filter system which is indicative of the electrical admittance;

generating the error as a difference between the first electrical parameter as delayed by the non-zero delay and the second electrical parameter as filtered by the filter response; and adapting the filter response to minimize the error.

4. The method of claim 1, wherein the first electrical parameter is a voltage of the loudspeaker, the second electrical parameter is a current of the loudspeaker, and the electrical characteristic is an electrical impedance of the loudspeaker.

5. The method of claim 4, wherein the method further comprises:

filtering the second electrical parameter with a filter response of the adaptive filter system which is indicative of the electrical impedance;

generating the error as a difference between the first electrical parameter as delayed by the non-zero delay and the second electrical parameter as filtered by the filter response; and adapting the filter response to minimize the error.

6. The method of claim 1, further comprising:

modeling the loudspeaker based at least on the electrical characteristic; and setting a protection level of the loudspeaker based on the modeling.

7. The method of claim 1, wherein the truncated non-causality of the electrical characteristic models the electrical characteristic more accurately than an absence of the non-zero delay.

8. A system, comprising:

an adaptive filter system configured to estimate a response of an electrical characteristic of a loudspeaker based on an error between a first electrical parameter of the loudspeaker and a second electrical parameter of the loudspeaker; and a non-zero delay configured to provide a delay of the first electrical parameter relative to the second electrical parameter prior to calculation of the error such that the adaptive filter system captures a truncated non-causality of the electrical characteristic which models the electrical characteristic more accurately than an absence of the non-zero delay.

9. The system of claim 8, wherein the first electrical parameter is a current of the loudspeaker, the second electrical parameter is a voltage of the loudspeaker, and the electrical characteristic is an electrical admittance of the loudspeaker.

10. The system of claim 9, wherein the adaptive filter system is further configured to:

filter the second electrical parameter with a filter response of the adaptive filter system which is indicative of the electrical admittance; and adapting the filter response to minimize the error, wherein the error is a difference between the first electrical parameter as delayed by the non-zero delay and the second electrical parameter as filtered by the filter response.

11. The system of claim 8, wherein the first electrical parameter is a voltage of the loudspeaker, the second electrical parameter is a current of the loudspeaker, and the electrical characteristic is an electrical impedance of the loudspeaker.

12. The system of claim 11, wherein the adaptive filter system is further configured to:

filter the second electrical parameter with a filter response of the adaptive filter system which is indicative of the electrical impedance; and adapting the filter response to minimize the error, wherein the error is a difference between the first electrical parameter as delayed by the non-zero delay and the second electrical parameter as filtered by the filter response.

13. The system of claim 8, further comprising:

a speaker modeling block configured to model the loudspeaker based at least on the electrical characteristic; and a speaker protection block configured to set a protection level of the loudspeaker based on the modeling.

14. The system of claim 8, wherein the truncated non-causality of the electrical characteristic models the electrical characteristic more accurately than an absence of the non-zero delay.

* * * * *